United States Patent [19]

Bianco

[11] Patent Number: 4,887,508

[45] Date of Patent: Dec. 19, 1989

[54] CLEANING AND POLISHING TOOL

[76] Inventor: Rodolfo Bianco, 560 W. 21st Avenue, Vancouver, British Columbia, Canada, V5Z 1Y7

[21] Appl. No.: 220,170

[22] Filed: Jul. 18, 1988

[51] Int. Cl.[4] ..... F42B 33/02; F42B 35/02; F42B 33/00; B08B 1/00

[52] U.S. Cl. ..... 86/23; 15/104.04; 15/104.011; 15/88; 15/25; 15/160; 86/24

[58] Field of Search ..... 86/23, 24, 32; 15/23, 15/25, 88, 104.04, 104.05, 104.011, 104.01 R, 179, 160, 198; 51/73 R

[56] References Cited

U.S. PATENT DOCUMENTS

| | | | |
|---|---|---|---|
| 2,866,212 | 12/1958 | White et al. | 15/88 |
| 3,188,674 | 6/1965 | Hobbs | 15/104.04 |
| 3,224,029 | 12/1965 | Domingos | 15/104.04 |
| 4,238,867 | 12/1980 | Ruggero et al. | 15/88 |
| 4,301,567 | 11/1981 | Tucker | 15/104.04 |
| 4,467,489 | 8/1984 | Begneaud | 15/88 |
| 4,468,829 | 9/1984 | Christensen | 15/104.04 |
| 4,554,696 | 11/1985 | Nye, Jr. | 15/104.04 |
| 4,676,839 | 6/1987 | Osborn | 15/104.04 |
| 4,763,380 | 8/1988 | Sandvick | 15/104.04 |

FOREIGN PATENT DOCUMENTS

| | | | |
|---|---|---|---|
| 0664099 | 2/1988 | Switzerland | 15/104.04 |

*Primary Examiner*—Howard J. Locker

*Attorney, Agent, or Firm*—Fulwider, Patton, Rieber, Leé & Utecht

[57] ABSTRACT

A cleaning tool for cleaning the exterior of tubular members comprising a tubular body having a longitudinal axis along which a central cavity extends with an open end and a closed end at opposite ends of the longitudinal axis. The side walls of the tubular body have a pair of diametrically opposed slots extending from the open end to the closed end. A spindle mounted to the closed end of the tubular body is used for mounting the cleaning tool to a rotatable drive. Brushes adapted for engagement with the opposed slots to prevent rotation are inserted into the tubular body which is then fitted over the tubular member to be cleaned.

10 Claims, 1 Drawing Sheet

CLEANING AND POLISHING TOOL

FIELD OF THE INVENTION

This invention relates to a cleaning and polishing tool for cleaning the exterior of tubular members, and finds particular application as a tool for cleaning the external surface of the neck and body of brass cartridge cases.

BACKGROUND OF THE INVENTION

Brass cartridge cases become tarnished with time and use. The cartridge neck, if not the body, has to be cleaned of carbonated powder residue every time before it can be resized in an appropriate caliber dye and eventually reloaded. This cartridge case cleaning ritual has been accomplished in the past by employing various methods ranging from soaking the cases in various solutions for several hours, to scouring the case's exterior with steel wool or other abrasive compounds. These methods are less than satisfactory being both time consuming and messy.

A recent improvement in this field has been the introduction of rotating or vibrating tumblers filled with abrasive media into which the cartridge cases are placed. This is currently the preferred method of cartridge case cleaning. However, these tumbler/vibrators are very expensive and are generally out of reach of the average shooter. They are also very slow. It may take 6–12 hours to clean one load of brass cartridge cases adquately.

The cleaning tool of the present application is not limited to cleaning cartridge cases and can also be used to clean the exterior of other tubular members. In this regard, prior art tube cleaning devices include:

U.S. Pat. No. 3,188,674, Hobbs
U.S. Pat. No. 4,301,567, Tucker
U.S. Pat. No. 2,866,212, White
U.S. Pat. No. 4,238,867, Ruggero
U.S. Pat. No. 4,468,829, Christensen.

Unlike the prior art, the cleaning tool of the present application is able to clean tubes of varying diameter simultaneously.

SUMMARY OF THE INVENTION

Accordingly, the present invention provides a cleaning tool for cleaning the exterior of tubular members comprising:

a tubular body having a longitudinal axis along which a central cavity extends with an open end and a closed end at opposite ends of the longitudinal axis, the side walls of said tubular body having a pair of diametrically opposed slots extending from said open end to said closed end;

attachment means mounted to the closed end of said tubular body for mounting said cleaning tool to a rotatable drive; and brush means for invention into said tubular body and adapted from engagement with said opposed slots to prevent rotation of the brush means.

BRIEF DESCRIPTION OF THE DRAWINGS

The cleaning tool of the present invention is illustrated in the accompanying drawings, in which.

DESCRIPTION OF THE PREFERRED EMBODIMENTS

Figure 1:
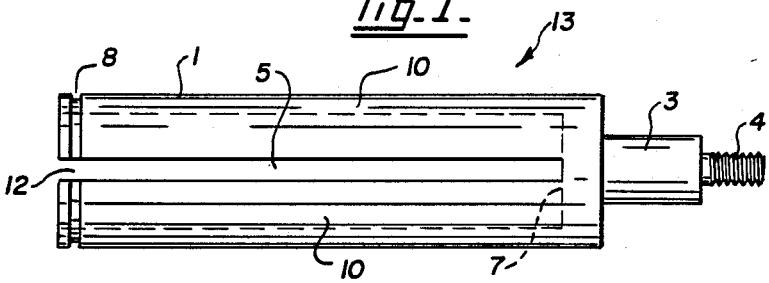
FIG. 1 is a side view of a preferred embodiment of the cleaning tool of the present invention.
Figure 3:
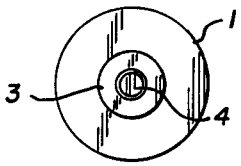
FIG. 3 is an end view looking at the closed end of the cleaning tool.

Referring to FIG. 1, there is shown a preferred embodiment of the cleaning tool 13. The tool comprises a tubular body 1 having side walls 10 and an open end 12 and a closed end 7 at opposite ends of the body's longitudinal axis. Mounted to closed end 7 is attachment means 3 to allow the cleaning tool to be attached to various tools for rotating the tubular body. Preferably, attachment means 3 comprises a spindle aligned with the longitudinal axis of the body as shown in FIG. 3. The spindle is suitable for insertion into the chuck of a rotatable drive such as an electric drill or the like. Additionally, attachment means 3 may include a threaded shaft 4 so that the cleaning tool may be attached to a handle for manual rotation.

A pair of slots 5 are formed in the walls 10 of the tubular body and extend from open end 12 to closed end 7. These slots are formed to retain the brush means used with the cleaning tool.

Figure 2:
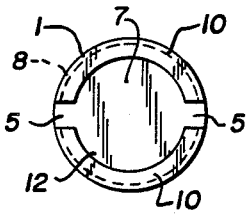
FIG. 2 is an end view looking into the open end of the cleaning tool.
Figure 4:
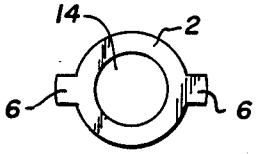
FIG. 4 is a top view of a brush element of the present invention.

A brush means is shown in FIG. 4 and comprises an essentially circular main body 2 having outwardly radially extending arms 6 and a central aperture 14. The brush means are preferably made from a material such as compressed felt. These brushes are dimensioned to fit tightly within the tubular cavity of body 1 such that arm 6 are engaged in slots 5 as shown in FIG. 2 to prevent rotation of the brushes with respect to the tubular body. To assist in maintaining the brushes within the tubular cavity, circumferential groove 8 is formed about the tubular body 1 adjacent open end 12. Groove 8 accepts a retaining ring that bears against the arms 6 of any inserted brush means to prevent movement along longitudinal axis of the body.

Figure 5:
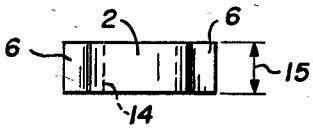
FIG. 5 is a side view of the brush element of FIG. 4.

The central aperture 14 of the brush means is shaped to fit over the exterior of a tube to be cleaned. Various brush means having a suitable central aperture can be used to clean the exterior of any tubular member. As shown in FIG. 5, brush means can be of made of various thicknesses 15 of material and stacked in a column within tubular body 1. By using brushes having a different sized apertures in the same stack, it is possible to clean tubular members having sections of different diameter simultaneously. Such a feature is advantageous when cleaning cartridge cases which tend to have a narrow neck and a larger diameter body.

Figure 6:
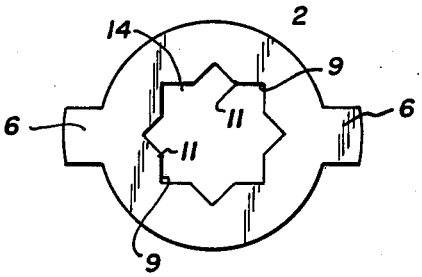
FIG. 6 is a detailed top view of the internal structure of a brush element.

In an alternative embodiment of the brush means, central aperture 14 may be formed as shown in FIG. 6. There are a plurality of inwardly extending points 11 that act as small brushes to clean and polish the exterior of the member being cleaned. Such an arrangement allows the points to clear away abrasive debris as the brush rotates over the member being cleaned and deposit the debris in the valleys 9 between the points thereby preventing the brushing points from becoming quickly soiled and extending the useful cleaning life of a brush means.

In use, the cleaning tool of the present invention is first filled with brush means having a central aperture 14 large enough to fit over the member to be cleaned. In the case of cartridge cases or other members having different diameter sections, the brush means are inserted in tubular body 1 such that the combined thickness of brush means having the same sized aperture will extend over the length of each different diameter section. The present invention is intended for use with all sizes of tubular members simply by inserting appropriately sized brush means within tubular body 1. Necessarily, the cleaning tool can be manufactured over a range of dimensions to cover any of size of tubular member with correspondingly sized brush means to fit tightly within the tubular body of the tool. In some cases, it may be necessary when cleaning smaller tubular members to fit "blank" brush means, that is brush means with no central aperture, into the tubular body 1 of the cleaning tool in order to fill the body between body's closed end 7 and the rim of the tubular member to be cleaned.

Once the cleaning tool has been filled with brush means appropriate to the member to be cleaned, a retaining ring is inserted into groove 8. If the brush means are a very tight fit within the tubular body 1, the retaining ring may not be necessary.

The cleaning tool is then attached by spindle 3 to a rotational drive such as an electric drill. Suitable clamping means are used to firmly hold the tubular member to be cleaned, and the rotating cleaning tool is placed over the member for cleaning by the abrading action of the brush means. In this manner, cleaning can continue until the desire finish is achieved.

If the member to be cleaned is very dirty, a small amount of cleaning or polishing solution may be applied to the central aperture 14 of the brush means before the cleaning operation is started.

When used specifically on cartridge cases, the cleaning tool of the present application is able to clean and polish simultaneously the neck and body of the case in no more than a few seconds.

In the event that an electric drill is not available, the clean tool may be attached to a handle by threaded portion 4 for manual operation.

I claim:

1. A cleaning tool for cleaning the exterior of tubular members comprising:

a tubular body having a longitudinal axis along which a central cavity extends with an open end and a closed end at opposite ends of the longitudinal axis, the side walls of said tubular body having a pair of diametrically opposed slots that cut through said side walls and extend from said open end to adjacent said closed end;

attachment means mounted to the closed end of said tubular body for mounting said cleaning tool to a rotatable drive; and brush means for insertion into said tubular body comprising a series of brush elements for insertion into said tubular body in a stacked column, each brush element comprising a main body shaped to fit tightly within said tubular body, said main body having a central aperture aligned with said longitudinal axis and outwardly extending projections that fit within said slots in said tubular body and protrude through said side walls to prevent rotation of said main body of said brush element with respect to the tubular body.

2. A cleaning tool as claimed in claim 1 in which said attachment means comprises a spindle for insertion into the chuck of a rotatable drive.

3. A cleaning tool as claimed in claim 1 in which said attachment means includes a threaded portion for attachment to a handle for manual operation of the cleaning tool.

4. A cleaning tool as claimed in claim 1 in which said central aperture of said brush element is formed with a plurality of inwardly extending fingers.

5. A cleaning tool as claimed in claim 1 in which said brush elements have different sized central apertures such that different groups of brush elements, each group having the same sized aperture, can be inserted into said tubular body of said cleaning tool to form a stacked column adapted to clean simultaneously the exterior of a tubular member having different diameter sections.

6. A cleaning tool as claimed in claim 5 in which said tubular member having different diameter sections is a cartridge case.

7. A cleaning tool as claimed in claim 1 in which said brush means is formed from compressed felt.

8. A cleaning tool as claimed in claim 1 including brush elements without a central aperture used as spacing members.

9. A cleaning tool as claimed in claim 1 including retaining means adjacent said open end of said tubular body.

10. A cleaning tool as claimed in claim 9 in which said retaining means comprises a groove about said tubular body for accepting a retaining clip to prevent longitudinal movement of said brush means.

* * * * *